US012735896B2

(12) United States Patent
Svendsen

(10) Patent No.: US 12,735,896 B2
(45) Date of Patent: Sep. 15, 2026

(54) LATERAL INTERMEDIATE FLASHING ELEMENT FOR CONNECTING LATERAL LONGITUDINAL FLASHING ELEMENTS, A KIT COMPRISING SUCH FLASHING ELEMENTS, AND A METHOD OF FLASHING TWO ROOF ELEMENTS POSITIONED ADJACENT EACH OTHER AT DIFFERENT ALTITUDES ALONG A SLANTED ROOF

(71) Applicant: VKR Holding A/S, Hørsholm (DK)

(72) Inventor: Jan Brix Svendsen, Hornsyld (DK)

(73) Assignee: VKR Holding A/S (DK)

( * ) Notice: Subject to any disclaimer, the term of this patent is extended or adjusted under 35 U.S.C. 154(b) by 231 days.

(21) Appl. No.: 18/621,211

(22) Filed: Mar. 29, 2024

(65) Prior Publication Data

US 2024/0337109 A1 Oct. 10, 2024

(30) Foreign Application Priority Data

Apr. 5, 2023 (DK) ..... PA 2023 70169

(51) Int. Cl.
*E04D 13/147* (2006.01)
*E04D 13/03* (2006.01)

(52) U.S. Cl.
CPC ..... *E04D 13/1475* (2013.01); *E04D 13/031* (2013.01); *E04D 13/147* (2013.01)

(58) Field of Classification Search
CPC ..... E04D 13/1475; E04D 13/0321; E04D 13/147; E04D 13/031
See application file for complete search history.

(56) References Cited

U.S. PATENT DOCUMENTS 4,543,753 A * 10/1985 Sonneborn ..... E04D 13/1475 52/211
5,065,553 A 11/1991 Magid
(Continued)

FOREIGN PATENT DOCUMENTS

DE 2910610 A1 3/1979
DK 154099 10/1988
(Continued)

OTHER PUBLICATIONS

European Search Report dated Sep. 10, 2024 that issued in connection with European Patent Application No. 24168729.2.
(Continued)

*Primary Examiner* — Andrew J Triggs
(74) *Attorney, Agent, or Firm* — Merek, Blackmon & Voorhees, LLC

(57) ABSTRACT

A lateral intermediate flashing element (100) for connecting lateral longitudinal flashing elements (200; 300) for flashing roof elements positioned adjacent each other at different altitudes along a slanted roof, comprises a longitudinal portion (110) with a generally L-shaped cross-section with a first leg (101) and a second leg (102), said second leg (102) comprising a slit-shaped pocket (105) with an opening towards a distal edge portion, the longitudinal portion (110) having an upper longitudinal end (120) and a lower longitudinal end (121), a width of the longitudinal portion (110) of the second leg (102) being smaller at the lower longitudinal end (121) than such width of the longitudinal portion (110) at the upper longitudinal end (120).

14 Claims, 6 Drawing Sheets

(56) References Cited

U.S. PATENT DOCUMENTS

| | | | | |
|---|---|---|---|---|
| 5,522,189 | A * | 6/1996 | Mortensen | E04D 13/031 52/537 |
| 12,428,193 | B2 * | 9/2025 | Henriksen | B65D 85/54 |
| 2024/0328162 | A1 * | 10/2024 | Svendsen | E04D 13/1475 |
| 2024/0337109 | A1 * | 10/2024 | Svendsen | E04D 13/031 |

FOREIGN PATENT DOCUMENTS

| | | | |
|---|---|---|---|
| EP | 0087647 | B1 | 4/1985 |
| EP | 1550777 | | 7/2005 |
| EP | 1581707 | B1 | 10/2009 |
| EP | 1521888 | | 11/2010 |
| EP | 2481864 | | 8/2012 |
| EP | 3061886 | A1 | 8/2016 |
| EP | 3480388 | | 5/2019 |
| FR | 2916464 | | 11/2008 |
| PL | 217499 | B1 | 7/2014 |
| PL | 226250 | B1 | 6/2017 |
| PL | 70359 | | 11/2018 |
| SE | 416072 | B | 11/1980 |
| WO | WO95/28535 | | 10/1995 |
| WO | WO03/074812 | | 9/2003 |
| WO | WO2020/071932 | A1 | 4/2020 |

OTHER PUBLICATIONS

Machine translation of DE2910610A1.
Machine translation of PL226250B1.
European Search Report dated Sep. 3, 2024 that issued in connection with European Patent Application No. 24166292.3.
Machine translation of description of PL217499B1.
Machine translation of description of SE416072B.
U.S. Appl. No. 18/626,522, filed Apr. 4, 2024.
U.S. Appl. No. 18/625,691, filed Apr. 3, 2024.
Extend Search Report dated Jul. 19, 2024 issued in connection with European Patent Application No. 24168726.8, eight (8) pages.
Machine translation of FR2916464.
Report dated Mar. 11, 2023 issued in connection with Danish Patent Application No. PA 2023 70169, eight (8) pages.

* cited by examiner

LATERAL INTERMEDIATE FLASHING ELEMENT FOR CONNECTING LATERAL LONGITUDINAL FLASHING ELEMENTS, A KIT COMPRISING SUCH FLASHING ELEMENTS, AND A METHOD OF FLASHING TWO ROOF ELEMENTS POSITIONED ADJACENT EACH OTHER AT DIFFERENT ALTITUDES ALONG A SLANTED ROOF

TECHNICAL FIELD

The present invention relates to a lateral intermediate flashing element for connecting lateral longitudinal flashing elements for flashing roof elements positioned adjacent each other at different altitudes along a slanted roof, said lateral longitudinal flashing elements having a generally L-shaped cross-section with a first leg and a second leg, the first leg being adapted to be arranged against a side of a respective one of the roof element raising from a plane of the roof in a mounted position, the second leg being arranged to extend along said plane of the roof in the mounted position, the first leg and the second leg being joined at a corner of the L-shape, inner sides of the first leg and the second leg relative to the L-shape constituting a concave side of the lateral longitudinal flashing element, a distal edge portion of the second leg opposite the corner being bent towards the concave side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape.

It should be noted that by "flat Z-shaped portion" and "flat Z-shape" should be understood that the element of the "Z" that connects the upper and lower portions of the "Z" at least in part extends parallel or substantially parallel to the upper and lower portions of the "Z".

The present invention further relates to a kit of flashing elements for flashing roof elements positioned adjacent each other at different altitudes along a slanted roof, comprising such lateral intermediate flashing element, and to a method of flashing two roof elements positioned adjacent each other at different altitudes along a slanted roof using such kit of flashing elements.

BACKGROUND ART

FIG. 1 shows a number of roof elements, more specifically roof windows, mounted in a slanted roof, on one hand adjacent each other in lateral or horizontal side-by-side relationship, and on the other hand adjacent each other at different altitudes along the slanted roof.

By the expression "at different altitudes along the slanted roof" should be understood that one window is placed further up the roof than a neighbouring window as it is shown in FIG. 1 and as it is known per se.

In FIG. 1, the wave lines around the windows indicate that the slanted roof is covered with tiles.

EP 3 480 388 A1 discloses a flashing member for a single roof element, such as a single roof window, and a flashing kit, wherein the flashing member is constituted by a lateral longitudinal flashing element as mentioned above and comprising a slit-shaped pocket with an opening towards a distal edge portion and a bottom towards a corner of an L-shape. The slit-shaped pocket provides for accommodating a second longitudinal element of sheet material comprising a first side to be inserted into the pocket. The second longitudinal element may e.g. as taught by EP 3 480 388 A1 be provided for covering a gap between the lateral longitudinal flashing element and a neighbouring a carrier profile 200 for supporting a solar collecting panel such as a photo-voltaic panel.

WO 95/28535 A1 discloses a flashing arrangement for mounting of a (single) roof element in a roof having a thin sheet-formed roofing. Thus, WO 95/28535 A1 likewise discloses a lateral longitudinal flashing element as mentioned above and comprising a slit-shaped pocket with an opening towards a distal edge portion and a bottom towards a corner of an L-shape, whereby the slit-shaped pocket provides for accommodating a longitudinal edge of thin sheet-formed roofing by said longitudinal edge being inserted into the pocket.

SUMMARY OF INVENTION

It is an object of the present invention to provide a lateral intermediate flashing element as mentioned by way of introduction.

This is obtained in that a lateral intermediate flashing element comprises a longitudinal portion having a generally L-shaped cross-section with a first leg and a second leg, the first leg being adapted to be arranged partly against respective sides of the roof elements, the second leg being arranged to extend along said plane of the roof in the mounted position, the first leg and the second leg being joined at a corner of the L-shape, an inner side of the first leg and an inner side of the second leg relative to the L-shape constituting a concave side of the longitudinal portion, a distal edge portion of the second leg opposite the corner being bent towards the concave side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape; and in that the longitudinal portion has an upper longitudinal end and a lower longitudinal end, a width of the longitudinal portion between the corner of the L-shape of the longitudinal portion and the apex being smaller at the lower longitudinal end than such width of the longitudinal portion at the upper longitudinal end. Hereby is obtained that the pockets of adjacent lateral longitudinal flashing elements may be combined as extensions of each other by means of the lateral intermediate flashing element, and e.g. a full length of sheet metal roofing may be applied next to roof elements or windows flashed using lateral longitudinal flashing elements the lateral intermediate flashing element.

In an embodiment the angle of the apex is smaller at the lower longitudinal end than at the upper longitudinal end. This further provides for facilitating use of the lateral intermediate flashing element for combining or connecting lateral intermediate flashing element.

In a practical embodiment the lateral intermediate flashing element further comprising a gutter flashing portion attached to the first leg of the longitudinal portion and said first leg comprises a recess corresponding to the gutter flashing portion.

The object is further obtained by a kit of flashing elements for flashing roof elements positioned adjacent each other at different altitudes along a slanted roof, comprising:

- a lateral intermediate flashing element according to the invention;
- a first lateral longitudinal flashing elements having a generally L-shaped cross-section with a first leg and a second leg, the first leg being adapted to be arranged against a side of a respective one of the roof element raising from a plane of the roof in a mounted position, the second leg being arranged to extend along said plane of the roof in the mounted position, the first leg and the second leg being joined at a corner of the L-shape, an inner side 101*a*, 201*a*, 301*a* of the first leg and an inner side 102*a*, 202*a*, 302*a* the second leg relative to the L-shape constituting a concave side of the lateral longitudinal flashing element, a distal edge portion of the second leg opposite the corner being bent towards the concave side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape; and a second lateral longitudinal flashing elements having a generally L-shaped cross-section with a first leg and a second leg, the first leg being adapted to be arranged against a side of a respective one of the roof element raising from a plane of the roof in a mounted position, the second leg being arranged to extend along said plane of the roof in the mounted position, the first leg and the second leg being joined at a corner of the L-shape, an inner side of the first leg and an inner side of the second leg relative to the L-shape constituting a concave side of the lateral longitudinal flashing element, a distal edge portion of the second leg opposite the corner being bent towards the concave side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape. Hereby is obtained that the pockets of the first and the second lateral longitudinal flashing elements may be combined as extensions of each other by means of the lateral intermediate flashing element and e.g. a full length of sheet metal roofing may be applied next to roof elements or windows flashed using the kit of flashing element.

In an embodiment wherein the second leg of the first lateral longitudinal flashing element, and the second lateral longitudinal flashing element, respectively has a width between the corner and the apex, and the pocket of the second leg of respectively the lateral intermediate flashing element, the first lateral longitudinal flashing element, and the second lateral longitudinal flashing element, has a depth that is equal to or larger than 50% of the width of the lower longitudinal end of the lateral intermediate flashing element; the first lateral longitudinal flashing element; and the second lateral longitudinal flashing element. This provides for adjusting the depth to which e.g. a second longitudinal element is inserted into the combined neighbouring pockets.

In a practical embodiment the angles forming the apexes are acute angles.

In another or further practical embodiment the opening of the slit-shaped pocket of respectively the lateral intermediate flashing element, the first lateral longitudinal flashing element, and the second lateral longitudinal flashing element is provided at a respective first bend portion, and the bottom of the respective slit-shaped pocket is provided by a respective second bend portion, and in a mounted position, a longitudinal part of the second bend portion of the first lateral longitudinal flashing element is accommodated in the slit-shaped pocket of the lateral intermediate flashing element at its upper longitudinal end, and a longitudinal part of the second bend portion of the lateral intermediate flashing element at its lower longitudinal end is accommodated in the slit-shaped pocket of the second lateral longitudinal flashing element.

Further, according to the invention a method is provided for flashing two roof elements positioned adjacent each other at different altitudes along a slanted roof, said method comprising:

providing a kit of flashing elements according to the invention, inserting in a longitudinal direction the lower end of the lateral intermediate flashing element into an upper longitudinal end of the second lateral longitudinal flashing element for a longitudinal part of the second bend portion of the lateral intermediate flashing element at its lower longitudinal end to be accommodated in the slit-shaped pocket of the second lateral longitudinal flashing element, and inserting in the longitudinal direction a lower longitudinal end of the first lateral longitudinal flashing element into the upper longitudinal end of the lateral intermediate flashing element for a longitudinal part of the second bend portion of the first lateral longitudinal flashing element to be accommodated in the slit-shaped pocket of the lateral intermediate flashing element at its upper longitudinal end.

BRIEF DESCRIPTION OF DRAWINGS

In the following the invention will be described in further detail by means of an example of an embodiment having reference to the accompanying schematic drawing, in which.

DESCRIPTION OF EMBODIMENTS

Figure 1:
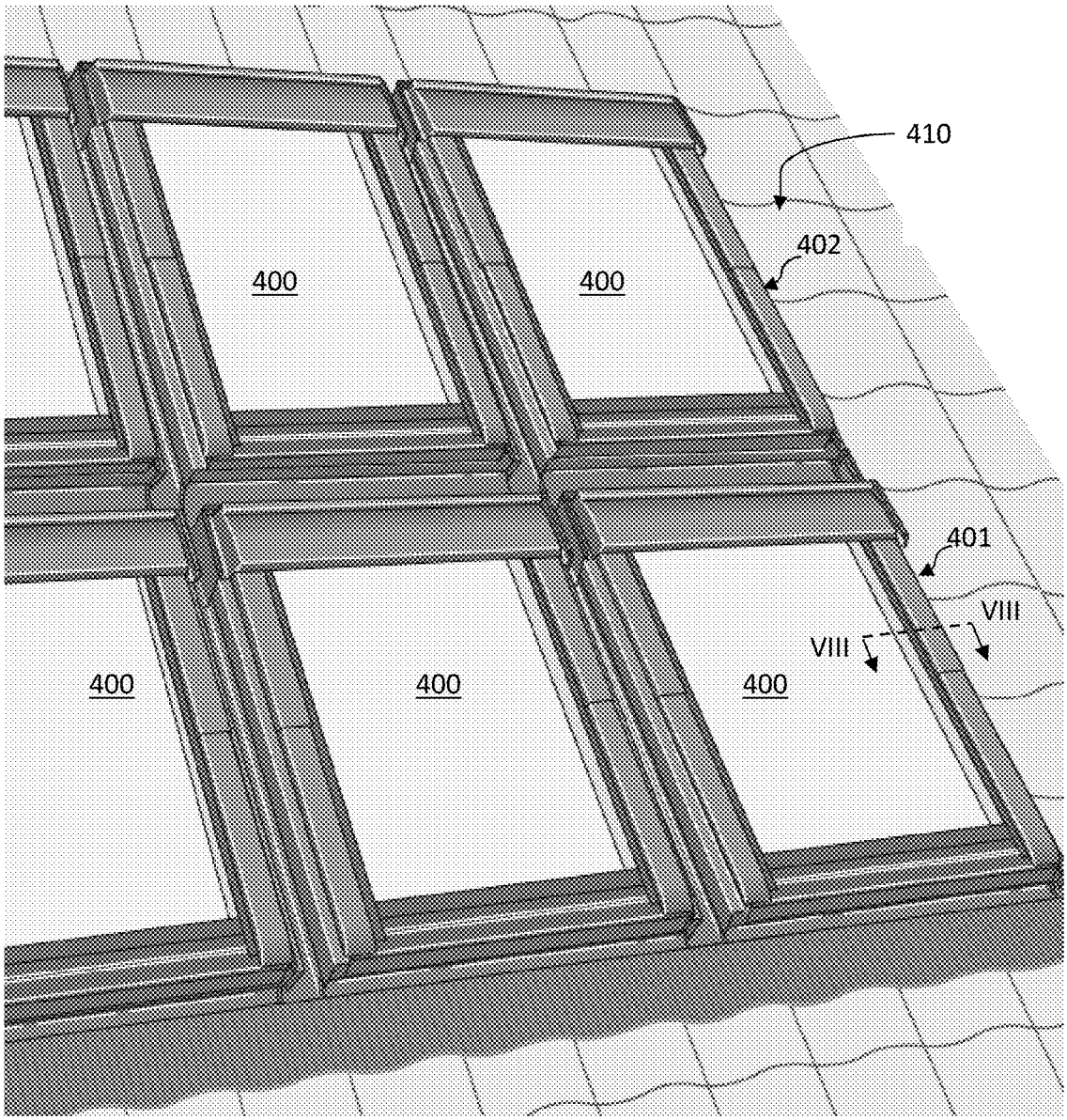
Fig. 1 Prior art
FIG. 1 is a prior art example of roof windows installed in a slanted roof.

FIGS. 2 to 7 show a kit of flashing elements 100, 200, 300 for flashing roof elements 400 positioned adjacent each other at different altitudes along a slanted roof 410, comprising a lateral intermediate flashing element, a first lateral longitudinal flashing element 200, and a second lateral longitudinal flashing element 300.

The lateral intermediate flashing element 100 is for connecting the lateral longitudinal flashing elements 200; 300, and the lateral intermediate flashing element 100 comprises a longitudinal portion 110 having a generally L-shaped cross-section with a first leg 101 and a second leg 102. The first leg 101 is adapted to be arranged partly against respective sides of the roof elements 400, and the second leg 102 is arranged to extend along the plane of the roof 410 in the mounted position. The first leg 101 and the second leg 102 are joined at a corner 103 of the L-shape, and an inner side 101*a* of the first leg 101 and an inner side 102*a* of the second leg 102 relative to the L-shape constitutes a concave side of the longitudinal portion 110. A distal edge portion 104 of the second leg 102 opposite the corner 103 is bent towards the concave side at an angle α1 to form an apex 114, and the second leg 102 comprises a slit-shaped pocket 105 with an opening towards the distal edge portion and a bottom 106 towards the corner 103 of the L-shape. The pocket 106 is provided by a flat Z-shaped portion of the second leg, whereby the flat Z-shaped portion has a cross-section with a flat Z-shape.

The longitudinal portion 110 has an upper longitudinal end 120 and a lower longitudinal end 121. A width W12 of the longitudinal portion 110 between the corner 103 of the L-shape of the longitudinal portion and the apex 114 is smaller at the lower longitudinal end 121 than such width W11 of the longitudinal portion 110 at the upper longitudinal end 120.

Figure 6:
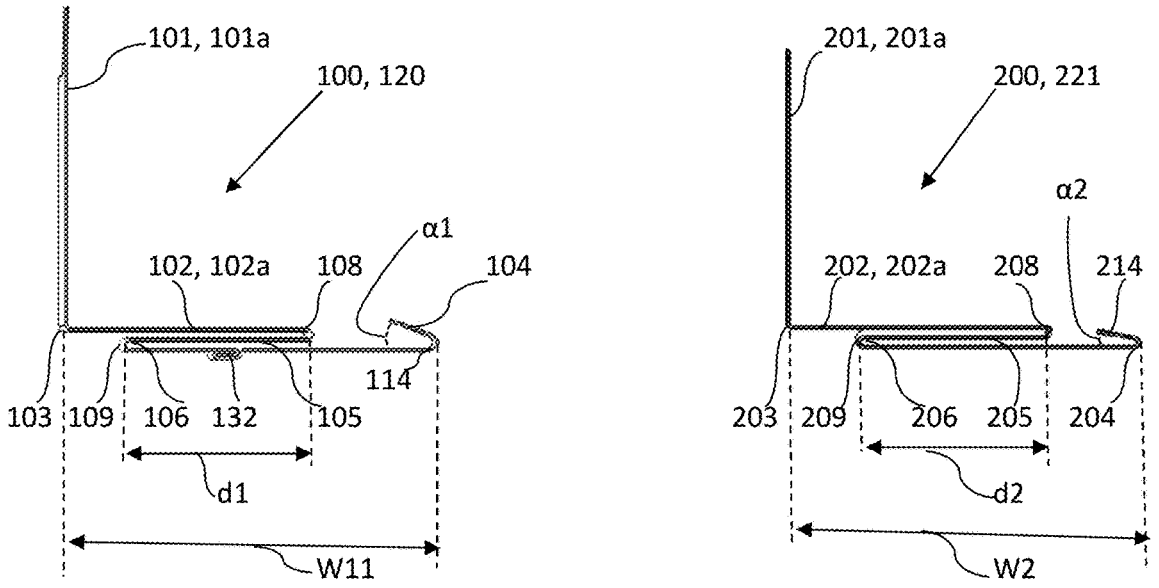
FIG. 6 shows a section as indicated by line VI-VI in FIG. 5.
Figure 7:
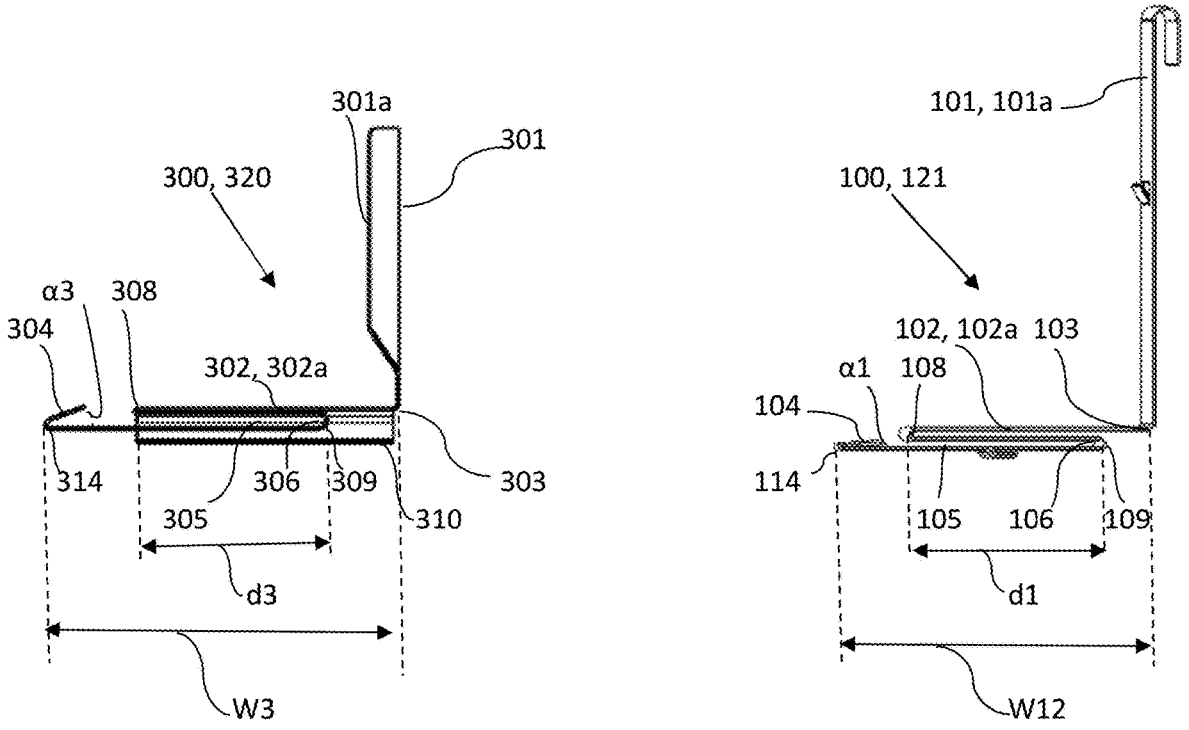
FIG. 7 shows a section as indicated by line VII-VII in FIG. 5.

In the embodiment shown, cf. FIGS. 6 and 7, the angle α1 of the apex 114 is smaller at the lower longitudinal end 121 than at the upper longitudinal end 120.

The lateral intermediate flashing element 100 further comprises a gutter flashing portion 130 attached to the first leg of the longitudinal portion and said first leg comprises a recess 131 corresponding to the gutter flashing portion.

The gutter flashing portion 130 provides in a manner known per se, together with other elements not shown, for flashing horizontally between adjacent roof elements or windows positioned adjacent each other at different altitudes along a slanted roof.

The first lateral longitudinal flashing elements 200 has a generally L-shaped cross-section with a first leg 201 and a second leg 202. The first leg 201 is adapted to be arranged against a side of a respective one of the roof elements 400 raising from a plane of the roof 410 in a mounted position. The second leg 202 is arranged to extend along said plane of the roof 410 in the mounted position. The first leg 201 and the second leg 202 are joined at a corner 203 of the L-shape, and an inner side 201*a* of the first leg and an inner side 202*a* of the second leg relative to the L-shape constitutes a concave side of the lateral longitudinal flashing element 200. A distal edge portion 204 of the second leg opposite the corner is bent towards the concave side at an angle α2 to form an apex 214 and said second leg 202 comprising a slit-shaped pocket 205 with an opening towards the distal edge portion and a bottom 206 towards the corner 203 of the L-shape. The pocket 206 is provided by a flat Z-shaped portion of the second leg, whereby the flat Z-shaped portion has a cross-section with a flat Z-shape.

The second said lateral longitudinal flashing elements 300 likewise has a generally L-shaped cross-section with a first leg 301 and a second leg 302. The first leg 301 is adapted to be arranged against a side of a respective one of the roof elements 400 raising from a plane of the roof 410 in a mounted position, and the second leg 302 is arranged to extend along said plane of the roof 410 in the mounted position. The first leg 301 and the second leg 302 are joined at a corner 303 of the L-shape, and an inner side 301*a* of the first leg and an inner side 302*a* the second leg relative to the L-shape constitutes a concave side of the lateral longitudinal flashing element 300. A distal edge portion 304 of the second leg opposite the corner is bent towards the concave side at an angle α3 to form an apex 314, and the second leg 302 comprising a slit-shaped pocket 305 with an opening towards the distal edge portion and a bottom 306 towards the corner 303 of the L-shape. The pocket 306 is provided by a flat Z-shaped portion of the second leg, whereby the flat Z-shaped portion has a cross-section with a flat Z-shape.

In the embodiment shown the second leg 202, 302 of the first lateral longitudinal flashing element 200, and the second lateral longitudinal flashing element 300, respectively has a width W between the corner 203, 303 and the apex 214, 314, and the pocket 105, 205, 305 of the second leg 102, 202, 302 of respectively the lateral intermediate flashing element 100, the first lateral longitudinal flashing element 200, and the second lateral longitudinal flashing element 300, has a depth d1; d2; d3 that is equal to or larger than 50% of the width W11; W2; W3 of the lower longitudinal end 121 of the lateral intermediate flashing element 100; the first lateral longitudinal flashing element 200; and the second lateral longitudinal flashing element 300.

In the embodiment shown the angles α1, α2, α3 forming the apexes 114, 214, 314 are acute angles.

Figure 2:
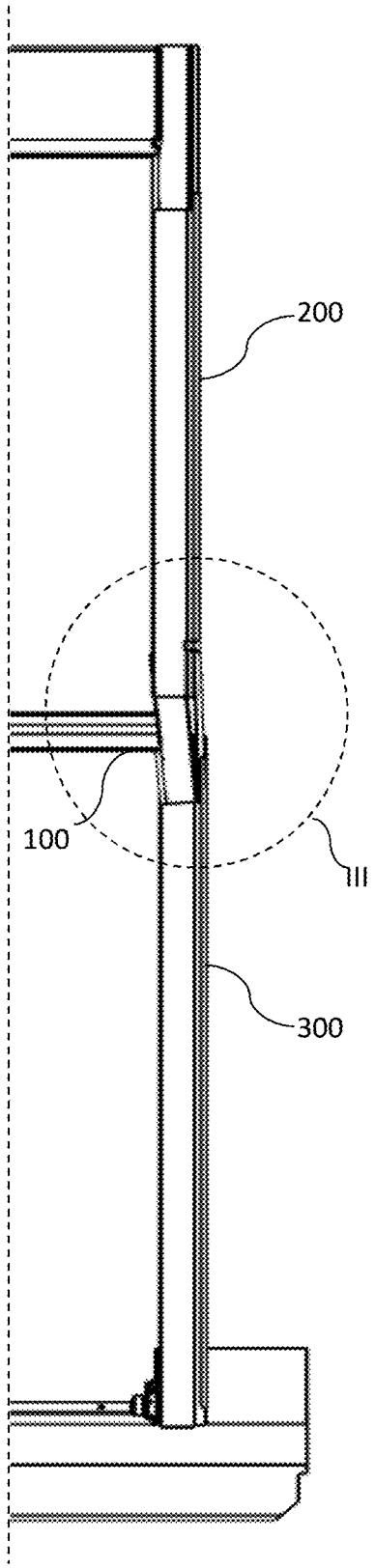
FIG. 2 shows the right-side part of a flashing for two roof elements or windows positioned adjacent each other at different altitudes along a slanted roof.
Figure 3:
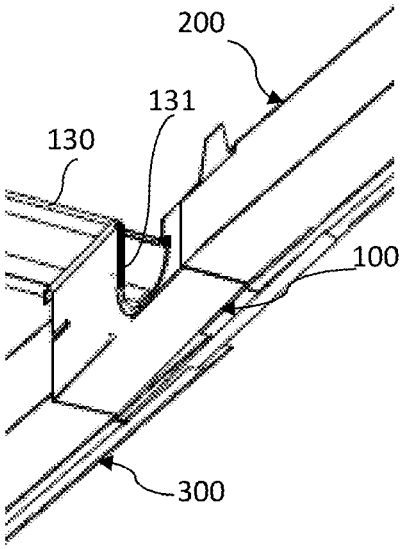
FIG. 3 shows in perspective a detail of the flashing shown in FIG. 2 generally indicated by circle III.
Figure 4:
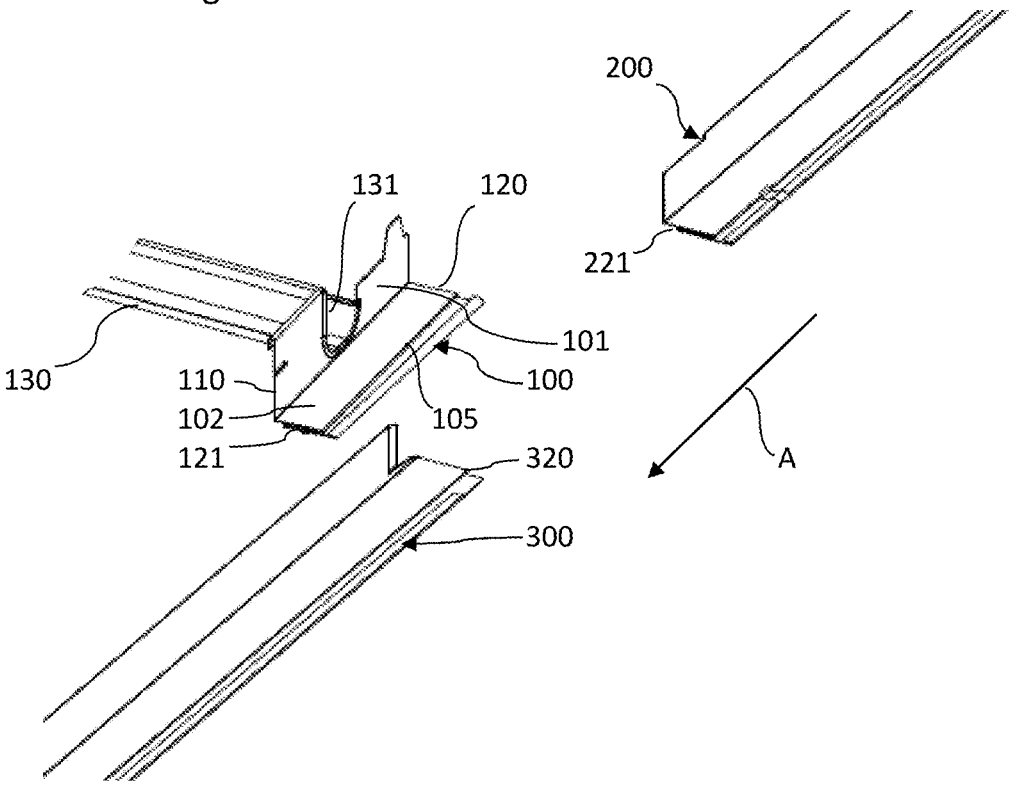
FIG. 4 shows an exploded view of the elements of FIG. 3.
Figure 5:
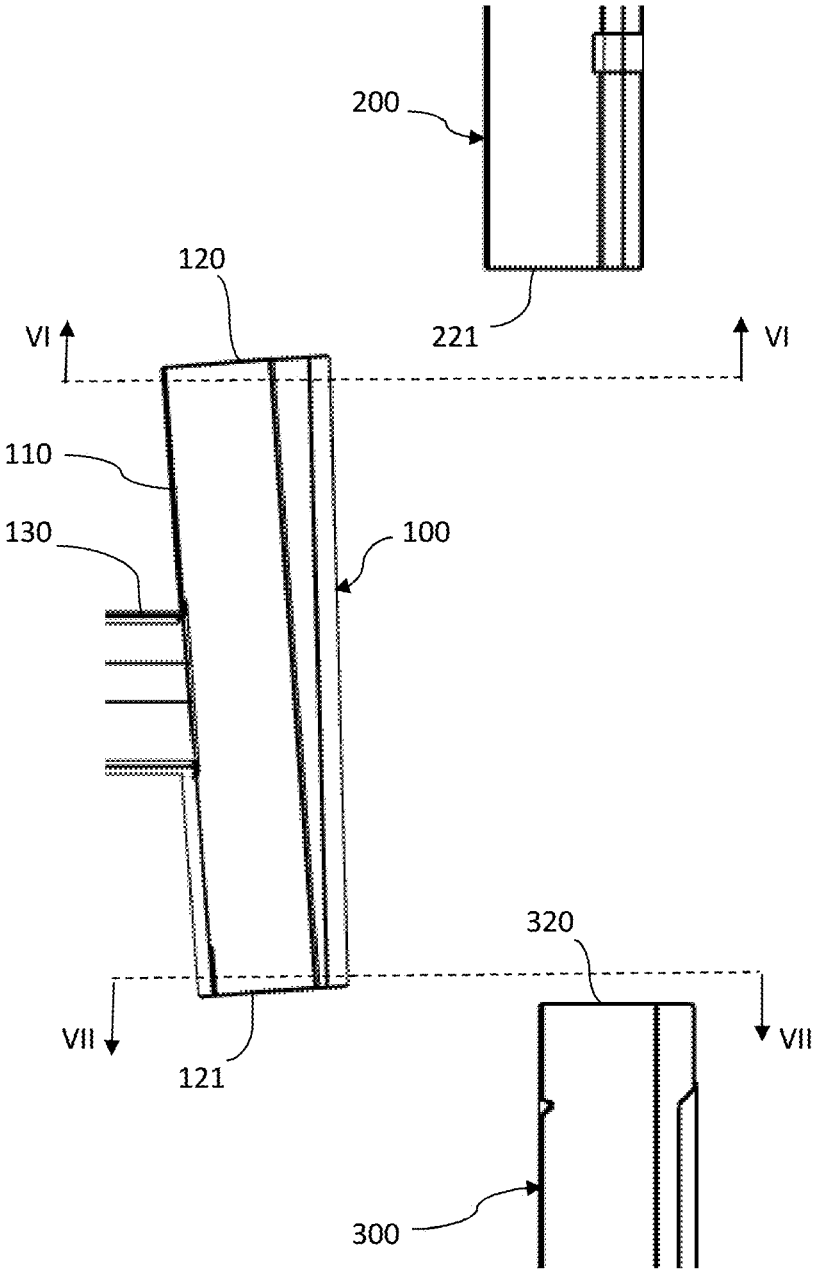
FIG. 5 shows a top view of the elements shown in FIG. 4.

In the embodiment shown the opening of the slit-shaped pocket 105, 205, 305 of respectively the lateral intermediate flashing element 100, the first lateral longitudinal flashing element 200, and the second lateral longitudinal flashing element 300 is provided at a respective first bend portion 108, 208, 308, and the bottom 106, 206, 306 of the respective slit-shaped pocket 105, 205, 305 is provided by a respective second bend portion 109 209, 309, and in a mounted position, cf. FIGS. 2 and 3, a longitudinal part of the second bend portion 209 of the first lateral longitudinal flashing element 200 is accommodated in the slit-shaped pocket 105 of the lateral intermediate flashing element 100 at its upper longitudinal end 120, and a longitudinal part of the second bend portion 109 of the lateral intermediate flashing element 100 at its lower longitudinal end 121 is accommodated in the slit-shaped pocket 305 of the second lateral longitudinal flashing element 300.

Referring to FIGS. 6 and 7, it is noted that the respective sizes or widths of the respective pockets 105, 205, and 305 in a vertical direction as seen in the figures should be sufficient to receive the respective intended bend portions and further the pockets thus joint should have open widths sufficient to receive a sheet-formed element, as explained below.

It is further noted that due to the Z-shape, apart from the pockets 105, 205, and 305 opening on the inner sides 102*a*, 202*a*, 302*a* of the second legs 102, 202, 302, respectively, second pockets parallel to the first pockets 105, 205, and 305 are opening at the respective second bend portions 109, 209, and 309. Some of these second pockets will also accommodate bend portions as it will be envisaged by the skilled person, but e.g. the second pocket of second lateral longitudinal flashing element 300 will not receive a bend portion and may be collapsed as seen in FIG. 7.

It should be noted that e.g. the longitudinal portion 110 of the lateral intermediate flashing element 100 may be provided as a single bent piece of sheet material or it may be provided e.g. from more bent pieces of sheet material that are connected e.g. by a joint 132.

Referring to the drawing of the second lateral longitudinal flashing element 300 in FIG. 7 it is noted, for the sake of clarity, that the part indicated by reference numeral 310 is a hooked portion at a distal end of the second lateral longitudinal flashing element 300.

In the embodiment shown the depths d1; d2; d3 of the pockets 105, 205, and 305 opening on the inner sides 102*a*, 202*a*, 302*a* of the second legs 102, 202, 302, respectively are substantially equal. The widths W2 and W3 of the first and second lateral longitudinal flashing elements 200 and 300 are substantially equal, whereas the width W12 of the lower longitudinal end 121 of the lateral intermediate flashing element 100 is smaller than the width W3 of the second lateral longitudinal flashing element 300, and width W11 of the upper longitudinal end 120 of the lateral intermediate flashing element 100 is larger than the width W2 of the first lateral longitudinal flashing element 200.

For flashing a roof element e.g. a roof window, the lateral intermediate flashing element, the first lateral longitudinal flashing elements 200, and the second lateral longitudinal flashing elements 300 may be assembled by

- inserting in a longitudinal direction A the lower end 121 of the lateral intermediate flashing element 100 into an upper longitudinal end 320 of the second lateral longitudinal flashing element 300 for a longitudinal part of the second bend portion 109 of the lateral intermediate flashing element 100 at its lower longitudinal end 121 to be accommodated in the slit-shaped pocket 305 of the second lateral longitudinal flashing element 300, and
- inserting in the longitudinal direction A a lower longitudinal end 221 of the first lateral longitudinal flashing element 200 into the upper longitudinal end 120 of the lateral intermediate flashing element 100 for a longitudinal part of the second bend portion 209 of the first lateral longitudinal flashing element 200 to be accommodated in the slit-shaped pocket 105 of the lateral intermediate flashing element 100 at its upper longitudinal end 120.

FIG. 1 illustrates roof windows mounted at different altitudes along a slanted roof. In the example shown, windows are mounted in horizontal side-by-side relation in a lower row 401 and above the lower row 401 an upper row 402 of windows are mounted, thus at a higher altitude along the slanted roof.

Figure 8:
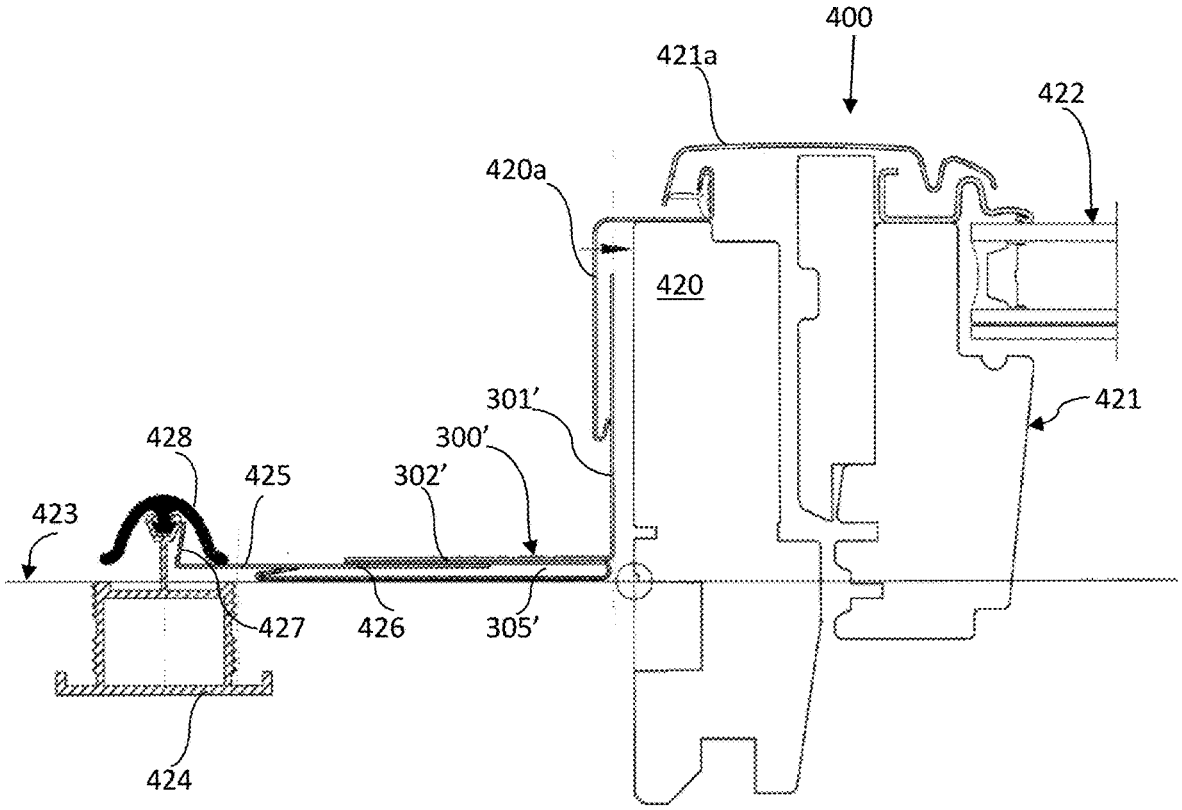
Fig. 8 Prior art
FIG. 8 illustrates the use of the flashing elements together with a second longitudinal element inserted into combined neighbouring pockets as taught by EP 3 480 388 A1.

Whereas FIG. 1 indicates that the roof is covered with tiles and the present invention is intended for the flashing to cooperate with sheet material, such as metal sheet material, line VIII-VIII in FIG. 1 indicates the general position of a section to provide a view as shown in FIG. 8.

FIG. 8 illustrates how the flashing according to the present invention may cooperate with a second longitudinal element e.g. as taught by EP 3 480 388 A1 from which FIG. 8 is replicated.

FIG. 8 partially shows part of the window 400 namely a main frame side element 420, a sash element 421, and a pane 422. Further FIG. 8 shows the second lateral longitudinal flashing element 300' in a variant having a slightly deeper pocket 305' than shown in FIG. 7. The shown lateral longitudinal flashing element 300' is mounted with its first leg 301' arranged against an external side of the main frame side element 420. The second leg 302' of the lateral longitudinal flashing element 300' is extending along the plane 423 of the roof. Further, the main frame side element 420 and the sash element 421 are respectively provided with cladding elements 420*a*, 421*a*.

Next to the window 400 a carrier profile 424 is provided for carrying e.g. a solar panel (not shown).

In order to provide for covering the roof between the window 400 and the carrier profile 424 a second longitudinal element 425 is provided. The second longitudinal element 425 is a sheet element with a first side portion 426 accommodated in the pocket 305' of the lateral longitudinal flashing element 300', and with a second side comprising a bent edge portion 427. A gasket 428 provides for completing coverage of the roof between the second longitudinal element 425 and the carrier profile 424.

The present invention provides for a combined slit-shaped pocket 105, 205, 305 to extend all along roof windows, or other roof elements, mounted next to each other at different altitude, as shown in FIG. 1, whereby the combined slit-shaped pocket may receive e.g. a second longitudinal element like the second longitudinal element 425 extending all along the combined length of the roof windows or roof elements.

As an alternative to a second longitudinal element like the second longitudinal element 425 the combined slit-shaped pocket 105, 205, 305 may receive sheet covering for a roof as taught in the above-mentioned WO 95/28535 A1.

LIST OF REFERENCE NUMERALS

100 lateral intermediate flashing element
101 first leg
101*a* inner side (of first leg)
102 second leg
102*a* inner side (of second leg)
103 corner
104 distal edge portion
114 apex
105 slit-shaped pocket
106 bottom
108 first bend portion
109 second bend portion
110 longitudinal portion
120 upper longitudinal end
121 lower longitudinal end
130 gutter flashing portion
131 recess
132 joint
200 first lateral longitudinal flashing elements
201 first leg
201*a* inner side (of first leg)
202 second leg
202*a* inner side (of second leg)
203 corner of the L-shape
204 distal edge portion of the second leg
214 apex
205 slit-shaped pocket
206 bottom
208 first bend portion
209 second bend portion
221 lower longitudinal end
300 second lateral longitudinal flashing elements
301 first leg
301*a* inner side (of first leg)
302 second leg
302*a* inner side (of second leg)
303 corner of the L-shape
304 distal edge portion of the second leg
314 apex
305 slit-shaped pocket
306 bottom

308 first bend portion
309 second bend portion
310 hooked portion (at distal end)
320 upper longitudinal end
400 roof elements
401 lower row (of roof elements)
402 upper row (of roof elements)
410 slanted roof
α1, α2, α3 angle of apex
A longitudinal direction
W11, W12, W2, W3 width
d1, d2, d3 depth
401 lower row (of windows)
402 upper row (of windows)
420 main frame side element, (external side of the main frame side element 420)
420*a* cladding element
421 sash element
421*a* cladding element
422 pane
423 plane (of the roof)
424 carrier profile
425 second longitudinal element
426 first side portion (of - - - " - - - )
427 bent edge portion
428 gasket
300' second lateral longitudinal flashing element
301' first leg
302' second leg
305' pocket

The invention claimed is:

1. A lateral intermediate flashing element for connecting lateral longitudinal flashing elements for flashing roof elements positioned adjacent each other at different altitudes along a slanted roof, said lateral longitudinal flashing elements each having a generally L-shaped cross-section with a first leg and a second leg, the first leg being adapted to be arranged against a side of a respective one of the roof elements raising from a plane of the roof in a mounted position, the second leg being arranged to extend along said plane of the roof in the mounted position, the first leg and the second leg being joined at a corner of the L-shape, an inner side of the first leg and an inner side of the second leg relative to the L-shape constituting a first side of the lateral longitudinal flashing element, a distal edge portion of the second leg opposite the corner being bent towards the first side at an angle to form an apex, and said second leg comprising a slit-shaped pocket with an opening on the inner side towards the distal edge portion and a bottom towards the corner of the L-shape, said pocket being provided by a flat Z-shaped portion of the second leg, said flat Z-shaped portion having a cross-section with a flat Z-shape;

wherein the lateral intermediate flashing element comprises:

a longitudinal portion having a generally L-shaped cross-section with a first leg and a second leg, the first leg being adapted to be arranged partly against respective sides of the roof elements, the second leg being arranged to extend along said plane of the roof in the mounted position, the first leg and the second leg being joined at a corner of the L-shape, an inner side of the first leg and an inner side of the second leg relative to the L-shape constituting a first side of the longitudinal portion, a distal edge portion of the second leg opposite the corner being bent towards the first side at an angle to form an apex, and said second leg comprising a slit-shaped pocket with an opening on the inner side towards the distal edge portion and a bottom towards the corner of the L-shape, said pocket being provided by a flat Z-shaped portion of the second leg, said flat Z-shaped portion having a cross-section with a flat Z-shape;

the longitudinal portion having an upper longitudinal end and a lower longitudinal end, a width of the longitudinal portion between the corner of the L-shape of the longitudinal portion and the apex being smaller at the lower longitudinal end than such width of the longitudinal portion at the upper longitudinal end.

2. A lateral intermediate flashing element according to claim 1, wherein the angle of the apex is smaller at the lower longitudinal end than at the upper longitudinal end.

3. A lateral intermediate flashing element according to claim 1, further comprising a gutter flashing portion attached to the first leg of the longitudinal portion and said first leg comprises a recess corresponding to the gutter flashing portion.

4. A kit of flashing elements for flashing roof elements positioned adjacent each other at different altitudes along a slanted roof, comprising:

a lateral intermediate flashing element according to claim 1;

a first lateral longitudinal flashing elements having a generally L-shaped cross-section with a first leg and a second leg, the first leg being adapted to be arranged against a side of a respective one of the roof elements raising from a plane of the roof in a mounted position, the second leg being arranged to extend along said plane of the roof in the mounted position, the first leg and the second leg being joined at a corner of the L-shape, an inner side of the first leg and an inner side of the second leg relative to the L-shape constituting a first side of the lateral longitudinal flashing element, a distal edge portion of the second leg opposite the corner being bent towards the first side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape; and a second lateral longitudinal flashing elements having a generally L-shaped cross-section with a first leg and a second leg, the first leg being adapted to be arranged against a side of a respective one of the roof elements raising from a plane of the roof in a mounted position, the second leg being arranged to extend along said plane of the roof in the mounted position, the first leg and the second leg being joined at a corner of the L-shape, an inner side of the first leg and an inner side of the second leg relative to the L-shape constituting a first side of the lateral longitudinal flashing element, a distal edge portion of the second leg opposite the corner being bent towards the first side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape.

5. A kit of flashing elements according to claim 4, wherein the lateral intermediate flashing element comprises a gutter flashing portion attached to the first leg of the longitudinal portion and said first leg comprises a recess corresponding to the gutter flashing portion.

6. A kit of flashing elements according to claim 5, wherein the second leg of the first lateral longitudinal flashing element, and the second lateral longitudinal flashing element, respectively has a width between the corner and the apex, and the pocket of the second leg of respectively the lateral intermediate flashing element, the first lateral longitudinal flashing element, and the second lateral longitudinal flashing element, has a depth that is equal to or larger than 50% of the width of the lower longitudinal end of the lateral intermediate flashing element; the first lateral longitudinal flashing element; and the second lateral longitudinal flashing element.

7. A kit of flashing elements according to claim 6, wherein the opening of the slit-shaped pocket of respectively the lateral intermediate flashing element, the first lateral longitudinal flashing element, and the second lateral longitudinal flashing element is provided at a respective first bend portion, and the bottom of the respective slit-shaped pocket is provided by a respective second bend portion, and in a mounted position, a longitudinal part of the second bend portion of the first lateral longitudinal flashing element is accommodated in the slit-shaped pocket of the lateral intermediate flashing element at its upper longitudinal end, and a longitudinal part of the second bend portion of the lateral intermediate flashing element at its lower longitudinal end is accommodated in the slit-shaped pocket of the second lateral longitudinal flashing element.

8. A kit of flashing elements according to claim 4, wherein the second leg of the first lateral longitudinal flashing element, and the second lateral longitudinal flashing element, respectively has a width between the corner and the apex, and the pocket of the second leg of respectively the lateral intermediate flashing element, the first lateral longitudinal flashing element, and the second lateral longitudinal flashing element, has a depth that is equal to or larger than 50% of the width of the lower longitudinal end of the lateral intermediate flashing element; the first lateral longitudinal flashing element; and the second lateral longitudinal flashing element.

9. A kit of flashing elements according to claim 8, wherein the opening of the slit-shaped pocket of respectively the lateral intermediate flashing element, the first lateral longitudinal flashing element, and the second lateral longitudinal flashing element is provided at a respective first bend portion, and the bottom of the respective slit-shaped pocket is provided by a respective second bend portion, and in a mounted position, a longitudinal part of the second bend portion of the first lateral longitudinal flashing element is accommodated in the slit-shaped pocket of the lateral intermediate flashing element at its upper longitudinal end, and a longitudinal part of the second bend portion of the lateral intermediate flashing element at its lower longitudinal end is accommodated in the slit-shaped pocket of the second lateral longitudinal flashing element.

10. A kit of flashing elements according to claim 4, wherein the angles forming the apexes are acute angles.

11. A kit of flashing elements according to claim 4, wherein the opening of the slit-shaped pocket of respectively the lateral intermediate flashing element, the first lateral longitudinal flashing element, and the second lateral longitudinal flashing element is provided at a respective first bend portion, and the bottom of the respective slit-shaped pocket is provided by a respective second bend portion, and in a mounted position, a longitudinal part of the second bend portion of the first lateral longitudinal flashing element is accommodated in the slit-shaped pocket of the lateral intermediate flashing element at its upper longitudinal end, and a longitudinal part of the second bend portion of the lateral intermediate flashing element at its lower longitudinal end is accommodated in the slit-shaped pocket of the second lateral longitudinal flashing element.

12. A method of flashing two roof elements positioned adjacent each other at different altitudes along a slanted roof, said method comprising:

providing a kit of flashing elements comprising a lateral intermediate flashing element comprising a longitudinal portion having a generally L-shaped cross-section with a first leg and a second leg, the first leg being adapted to be arranged partly against respective sides of the roof elements, the second leg being arranged to extend along said plane of the roof in the mounted position, the first leg and the second leg being joined at a corner of the L-shape, an inner side of the first leg and an inner side of the second leg relative to the L-shape constituting a first side of the longitudinal portion, a distal edge portion of the second leg opposite the corner being bent towards the first side at an angle to form an apex, and said second leg comprising a slit-shaped pocket with an opening on the inner side towards the distal edge portion and a bottom towards the corner of the L-shape, said pocket being provided by a flat Z-shaped portion of the second leg, said flat Z-shaped portion having a cross-section with a flat Z-shape, the longitudinal portion having an upper longitudinal end and a lower longitudinal end, a width of the longitudinal portion between the corner of the L-shape of the longitudinal portion and the apex being smaller at the lower longitudinal end than such width of the longitudinal portion at the upper longitudinal end;

a first lateral longitudinal flashing element having a generally L-shaped cross-section with a first leg and a second leg, the first leg being adapted to be arranged against a side of a respective one of the roof elements raising from a plane of the roof in a mounted position, the second leg being arranged to extend along said plane of the roof in the mounted position, the first leg and the second leg being joined at a corner of the L-shape, an inner side of the first leg and an inner side of the second leg relative to the L-shape constituting a first side of the lateral longitudinal flashing element, a distal edge portion of the second leg opposite the corner being bent towards the first side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape; and a second lateral longitudinal flashing element having a generally L-shaped cross-section with a first leg and a second leg, the first leg being adapted to be arranged against a side of a respective one of the roof elements raising from a plane of the roof in a mounted position, the second leg being arranged to extend along said plane of the roof in the mounted position, the first leg and the second leg being joined at a corner of the L-shape, an inner side of the first leg and an inner side of the second leg relative to the L-shape constituting a first side of the lateral longitudinal flashing element, a distal edge portion of the second leg opposite the corner being bent towards the first side at an angle to form an apex, and said second leg comprising a slit-shaped pocket with an opening towards the distal edge portion and a bottom towards the corner of the L-shape, said pocket being provided by a flat Z-shaped portion of the second leg, said flat Z-shaped portion having a cross-section with a flat Z-shape, wherein the opening of the slit-shaped pocket of respectively the lateral intermediate flashing element, the first lateral longitudinal flashing element, and the second lateral longitudinal flashing element is provided at a respective first bend portion, and the bottom of the respective slit-shaped pocket is provided by a respective second bend portion, and in a mounted position, a longitudinal part of the second bend portion of the first lateral longitudinal flashing element is accommodated in the slit-shaped pocket of the lateral intermediate flashing element at its upper longitudinal end, and a longitudinal part of the second bend portion of the lateral intermediate flashing element at its lower longitudinal end is accommodated in the slit-shaped pocket of the second lateral longitudinal flashing element;

inserting in a longitudinal direction the lower end of the lateral intermediate flashing element into an upper longitudinal end of the second lateral longitudinal flashing element for a longitudinal part of the second bend portion of the lateral intermediate flashing element at its lower longitudinal end to be accommodated in the slit-shaped pocket of the second lateral longitudinal flashing element; and inserting in the longitudinal direction a lower longitudinal end of the first lateral longitudinal flashing element into the upper longitudinal end of the lateral intermediate flashing element for a longitudinal part of the second bend portion of the first lateral longitudinal flashing element to be accommodated in the slit-shaped pocket of the lateral intermediate flashing element at its upper longitudinal end.

13. The method of claim 12, wherein the angles of the kit of flashing elements forming the apexes are acute angles.

14. The method of claim 12, wherein the lateral intermediate flashing element further comprises a gutter flashing portion attached to the first leg of the longitudinal portion and said first leg comprises a recess corresponding to the gutter flashing portion.

* * * * *